US005217067A

United States Patent [19]

Landry et al.

[11] Patent Number: 5,217,067

[45] Date of Patent: Jun. 8, 1993

[54] APPARATUS FOR INCREASING FLOW IN OIL AND OTHER WELLS

[76] Inventors: Robert Landry, 47 Berwick Crescent NW., Calgary, Alberta, Canada, T3K 1P7; Kenneth W. Reber, Box 928, Beaver Lodge, Alberta, Canada, T0H 0C0

[21] Appl. No.: 738,027

[22] Filed: Jul. 30, 1991

[51] Int. Cl.[5] ..... F04F 1/20; E21B 34/10

[52] U.S. Cl. ..... 166/68; 137/155; 166/372; 417/115

[58] Field of Search ..... 166/68, 105, 325, 372; 417/54, 108, 115; 137/155, 515, 515.3

[56] References Cited

U.S. PATENT DOCUMENTS

| | | | |
|---|---|---|---|
| 1,547,197 | 7/1925 | Arbon | 166/71 X |
| 1,739,041 | 12/1929 | Ragland | 417/108 |
| 2,275,947 | 3/1942 | Courtney | 417/109 |
| 3,873,238 | 3/1975 | Elfarr | 166/372 X |
| 5,105,889 | 4/1992 | Misikov et al. | 166/372 |

FOREIGN PATENT DOCUMENTS

| | | | |
|---|---|---|---|
| 2300920 | 9/1976 | France | 417/108 |

*Primary Examiner*—David J. Bagnell
*Attorney, Agent, or Firm*—Bereskin & Parr

[57] ABSTRACT

An injection valve for use in a well, for example, an oil well, enables gas to be injected to cause the oil or other fluid to be lifted to the surface. The valve has a valve body having an inlet at one end and an outlet at the other end, which are adapted to be fitted into conventional production oil tubing. Within the valve body, there are a plurality of ducts extending through between the inlet and the outlet, for the flow of oil or other fluid. A gas injection port opens into the outlet of the valve body and there is at least one gas inlet opening in the side of the valve body, which is connected to that gas injection port. This enables compressed gas to be sent down the well between the casing and the tubing, and injected through the gas injection port into the flow of oil.

14 Claims, 5 Drawing Sheets

APPARATUS FOR INCREASING FLOW IN OIL AND OTHER WELLS

FIELD OF THE INVENTION

This invention relates to the recovery of crude oil from oil wells, and more particularly relates to a technique of injecting gas into an oil well to cause the oil to flow out from the well, and such a technique for causing water or other fluid to flow out of a well.

BACKGROUND OF THE INVENTION

At the present time, it is common to permit oil wells to flow under their own natural pressure as long as they will do so and then to apply a mechanical reciprocating pump to complete the removal of the oil. This method, although in general use, is cumbersome and unsatisfactory. Because suction will only raise oil for a distance of some 35 feet, it is necessary to have the pump near the bottom of the well so that it can exert pressure instead of suction on the oil coming out of the well. This involves the use of pump rods of lengths of 5,000 feet or greater in many instances and when the pump plunger or the valves become worn, it is necessary to remove the pump from that depth to replace the worn parts. Furthermore, the collars on the pump rod wear rapidly and all the pump parts do likewise because of the small particles of grit that remain in the oil and the whole device is mechanically inefficient because of the relatively long pump rods that must be reciprocated to perform the pumping operation.

When the natural flow of crude oil from a well has ceased or become too slow for economical production, artificial production methods are employed, and in many cases, it is advantageous, at least during the first part of the artificial production period, to employ gas lift. Numerous types of equipment for producing oil by gas lift are available, but they all rely upon the same general principles of operation. In the usual case, dry gas consisting essentially of methane and ethane is forced down the annulus between the tubing and the casing and into the oil in the tubing. As the oil in the tubing becomes mixed with gas, the density of the oil decreases, and eventually the weight of the column of the gasified oil in the tubing becomes less than the pressure exerted on the body of oil in the well, and flow of oil occurs at the surface. While in some cases the dry gas may be introduced through the tubing so as to cause production through the annulus, this is not preferred unless special conditions are present.

One known gas lift technique is employed in oil wells, which have difficulty in producing naturally, that is, wells in which the formation pressure is not sufficient to cause the well to produce at an acceptable volume. This gas lift technique injects gas into the casing, which has been sealed or packed off at the bottom of the hole relative to the production tubing. A gas lift valve is placed in the production tubing at the production level, and the gas lift valve permits the gas to be injected into or bubble very slowly into the fluid being produced from the well. This gas then makes the fluid in the production tube somewhat lighter and, hence, the natural formation pressure will be sufficient to push the fluid up and out of the well. This means that the well can be produced at a greater rate. This gas lift technique is known as continuous gas lift.

A further adaptation of this gas lift technique is known as intermittent gas lift. In this technique, rather than letting the gas enter the production tube slowly, the gas is injected into the production tubing very quickly, in short bursts, thereby forming a large slug of fluid in the production tubing above the injected gas bubble. The gas bubble then drives the slug of fluid in the production tubing upwardly. The technique is repeated successively, thereby producing successive slugs of fluid at the wellhead.

Another type of gas lift tool involves a procedure where a string of production fluid extending from the surface to the zone of interest is provided with a number of gas lift valves positioned at spaced intervals along the length of the tubing. Gas is injected from the annulus between the tubing and well pipe through the gas lift valves and into the tubing for the purpose of forcing liquid upwardly to the surface and ultimately into a flowline that is connected with the production tubing. Gas lift systems for liquid production are quite expensive due to the cumulative expense of the number of gas lift valves that are ordinarily necessary for each well. Moreover, each of the gas lift valves must be preset for operation at differing pressures because of the vertical spacing thereof within the tubing string and because the valves must function in an interrelated manner to achieve lifting of liquid within the tubing string.

A common problem encountered in producing a well by gas lift arises in starting the flow of oil. The gas lift systems available on the market generally comprise of an arrangement of valves in the tubing whereby the gas may be introduced first into the upper part of the column of oil in the tubing and then at lower points so that it is not necessary to raise the entire column of oil in the tubing a substantial distance prior to the mixture of the gas with the oil. These systems of gas lift satisfactorily accomplish the object of lessening the problem of starting production. When the crude oil being produced tends to deposit paraffin, the presence of the valves makes the job of cleaning paraffin from the tubing more difficult.

In the patent literature, there are a variety of proposals for gas lift apparatus and the like, and the following U.S. patents disclose various apparatus for producing crude oil using gas:

| U.S. Pat. No. | Patent | Date of Issue |
|---|---|---|
| 1,547,197 | Arbon | 28 July, 1925 |
| 2,034,798 | Clark | 24 March, 1936 |
| 2,275,947 | Courtney | 10 March, 1942 |
| 2,293,196 | Crump | 18 August, 1942 |
| 2,380,639 | Eris | 31 July, 1945 |
| 2,463,317 | Sanders | 1 March, 1949 |
| 3,234,890 | Adams et al | 15 Feb., 1966 |
| 3,718,407 | Newbrough | 27 Feb., 1973 |
| 3,814,545 | Waters | 4 June, 1974 |
| 3,873,238 | Elfarr | 25 March, 1975 |
| 4,267,885 | Sanderford | 19 May, 1981 |
| 4,390,061 | Short | 28 June, 1983 |
| 4,738,313 | McKee | 19 April, 1988 |

The Arbon patent, U.S. Pat. No. 1,547,197 provides a flow of gas through the annulus between the inner and outer tubing, to gasify the production liquid. Gasification jets inject the gas into the oil flow, and are provided with check valves to prevent back glow of production liquid. However, the production oil flows through a single duct, with the gas injected at the sides.

The Courtney patent, U.S. Pat. No. 2,275,947 has different size check valves for different lift off pressures, allowing the flow through the gasification orifices to be varied depending on the pressure of the supplied gas. A standing check valve located at the bottom of the mechanism prevents downward flow of production oil.

SUMMARY OF THE PRESENT INVENTION

In accordance with the present invention there is provided a valve for use in a well to provide gas lift to crude oil or other fluid, the valve comprising: a valve body having an inlet at one end and an outlet at the other end, adapted to be fitted into production tubing; a plurality of ducts extend through the valve body between the inlet and the outlet thereof, for a flow of production fluid; a gas injection port opening into the outlet of the valve body; and at least one gas inlet opening in the side of the valve body, which inlet opening is in communication with the gas injection port, for supply of gas thereto from outside the valve body.

By providing a plurality of ducts extending through the valve body for the flow of production oil, the mixing of the gas and the oil is promoted, to enhance the gas lift effect The present invention also provides a complete gas lift system, including production tubing within a well casing, with the injection valve provided in the production tubing. Below the injection valve, a packer is provided between the tubing and the casing, to prevent gas being injected down into the well. Below the packer, the tubing would be provided with a perforated section, closed at the end by a bull plug. The perforations permit the oil to flow into the tubing, and it is for preferred for these perforations to be of a smaller diameter than the ducts extending through the injection valve body, so that any sand or small rock particles entrained in the gas flow which manage to pass through into the tubing will be sufficiently small to flow through the ducts of the valve without blocking those ducts. It is further preferred for a check valve to be provided, advantageously below the injection valve, which check valve only permits oil to flow upwards. This prevents any inadvertent back flow of oil down the production tubing.

It is preferred for the injection valve, check valve and other fittings to be essentially compatible with conventional oil production tubing. This enables the various components to be assembled readily using conventional tools available at the wellhead for assembling components of production tubing. It further readily enables the tubing to be inserted down into the well casing, which is not the case where bulky valve fixtures of unusual dimensions are provided.

BRIEF DESCRIPTION OF THE DRAWINGS

For better understanding of the present invention, and to show more clearly how it may be carried into effect, reference will now be made, by way of example, to the accompanying drawings which show a preferred embodiment of the present invention and in which.

DESCRIPTION OF THE PREFERRED EMBODIMENT

Figure 1:
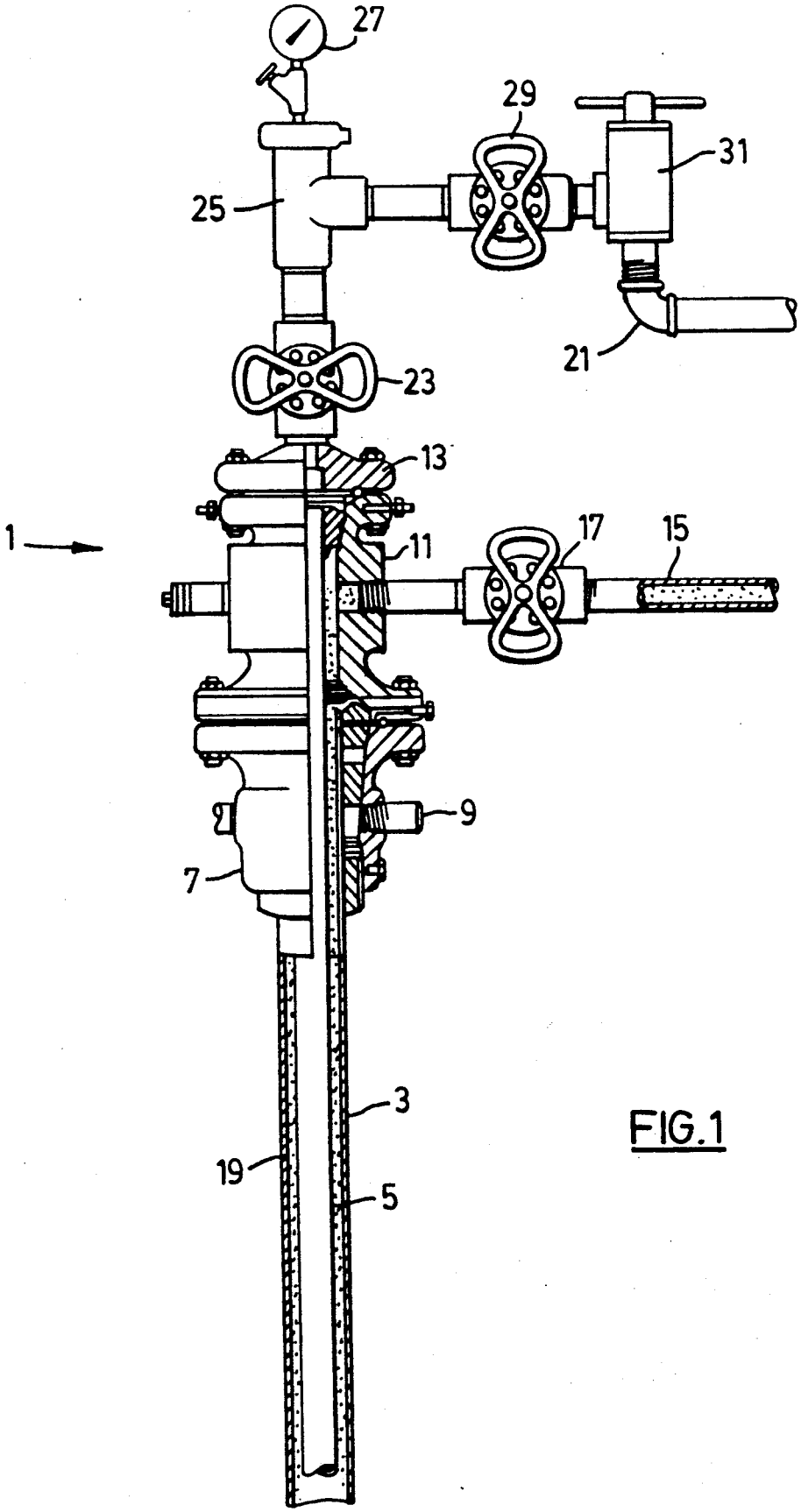
FIG. 1 is a side view, partially broken away, of a wellhead incorporating a gas lift system of the present invention.

Referring first to FIG. 1, there is shown a wellhead generally indicated by reference 1, connected to a casing 3 and production tubing 5. The casing 3 would usually be a 5½" casing, whilst the tubing 5 would typically be 2⅜" or 2⅞" tubing. A first or lower wellhead casing 7 is connected to the casing 3, and provides a connection at 9 to other tubing. A second or upper wellhead casing 11 is connected to the first wellhead casing 7. The production tubing 5 extends through the wellhead casings 7, 11 to a top or closure member 13, to which it is joined. A supply line for gas 15 includes a valve 17 and is connected to the upper wellhead casing 11, for supplying gas to an annulus generally indicated by the reference 19. The annulus 19 is located between the tubing 5 and casing 3 and extends up to the top closure member 13.

An output line 21 is connected to the top or closure 13 and includes a first control valve 23, and a T-junction 25 fitted with a pressure gauge 27. This in turn is connected to a second control valve 29 and a flow rate control valve 31.

Figure 2:
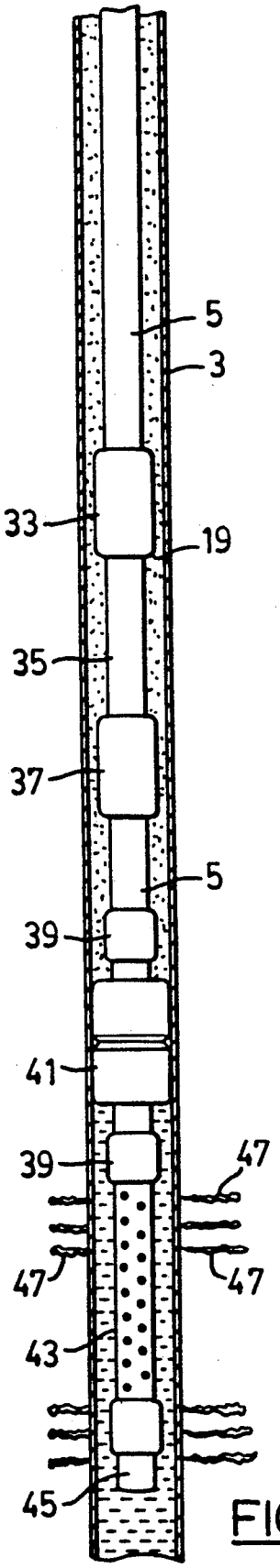
FIG. 2 is a side view, partially cut away of a lower portion of the well.

Turning to FIG. 2, the casing 3 and production tubing 5 extends down into the well in known manner, to the required depth. As indicated at 33, a gas injector valve in accordance with the present invention is provided in the tubing 5 and is connected via a pup joint 35, i.e. short length of tubing, to a check valve 37. The check valve 37 only permits oil to flow upwards.

The tubing 5 is further connected via joints 39 in known manner through a packer 41 to a perforated tube portion 43, which is closed by a bull plug 45 in known manner.

As indicated at 47, the perforated tube portion 43 would be located in an oil bearing layer or formation, with fissures and perforations permitting the oil to seep through into the lower end of the annulus 19. The well casing 3 would terminate above this layer.

Figure 3:
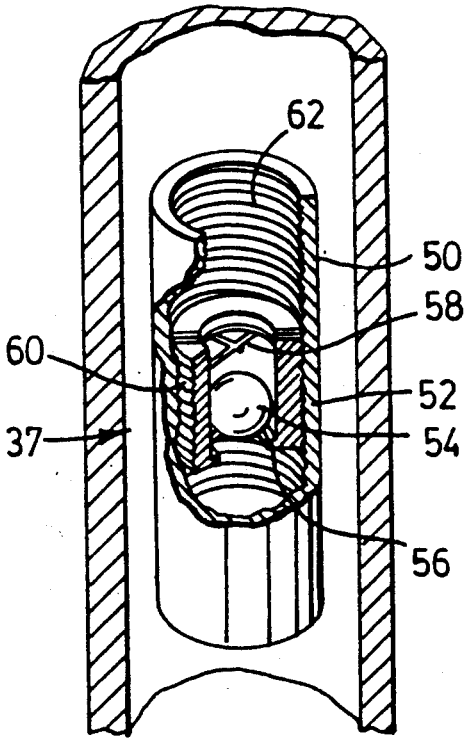
FIG. 3 is a perspective view, partially cut away, of a check valve used in the gas lift system of the present invention.

Turning to FIG. 3, this shows a check valve 37. The check valve 37 comprises a check valve 50 body and an insert 52, which provides a cage for a ball check valve. The ball for the valve is shown at 54, and is arranged for seating against a valve seat 56 to close the valve to prevent flow in a downward direction. Small bars or the like are provided at 58 to restrain the ball, whilst permitting free flow of oil.

The insert of 52 is screwed into a threaded central portion 60 of the valve body 50. At either end, the body 50 is provided with standard screw threads 62, for mating with appropriate pipe joints.

The valve body 50 is precision machined from J55 steel. The ball 54 and seat 56 are standard API standing valve, ball and seat components, as used in bottom-hole pumps. The insert 52 is made from 316 stainless steel.

Figure 4:
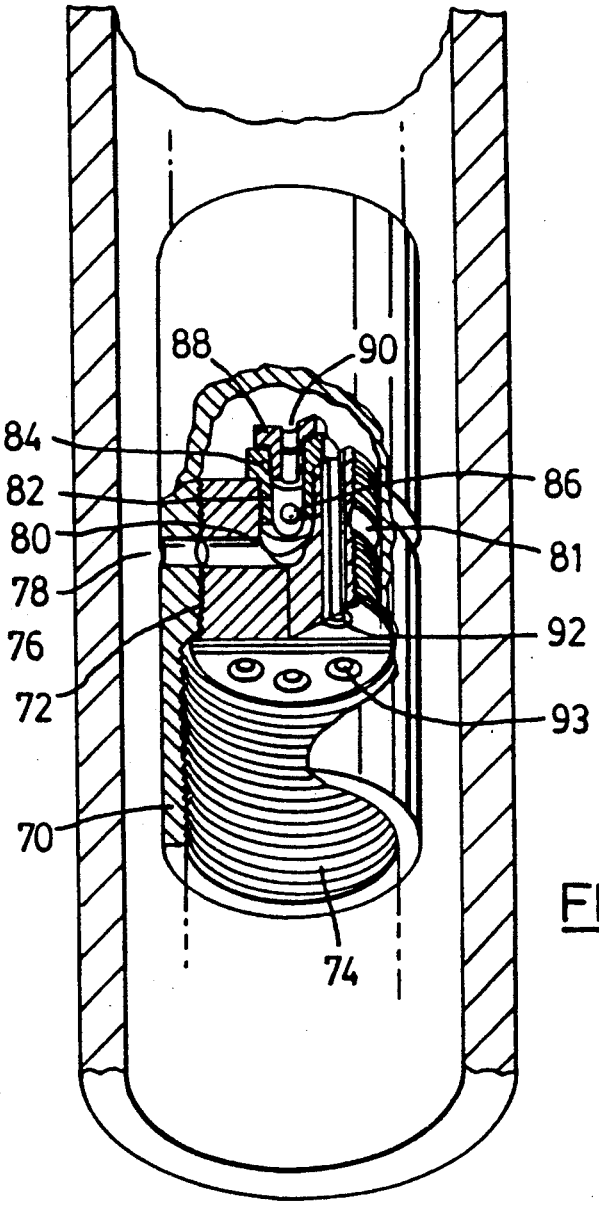
FIG. 4 is a perspective view, partially cut away of a gas injection valve in accordance with the present invention.

Turning to FIG. 4, the gas injector valve 33 comprises a valve body 70. Similar to the check valve body 50, this has a threaded central portion 72 of narrower internal diameter than the end portions. The end portions of the body 70, as indicated at 74 are provided with standard internal threads for mating with standard pipe joints.

An injection valve insert 76 has a screw thread and is screwed into the threaded central portion 72 as shown.

The central portion 72 is provided with a plurality of radial through bores 78 corresponding with inlet ports 80 of the valve insert 76. These ports 80 open into an axially extending opening 82, which is threaded. An orifice body 84 incorporating a ball check valve 86 is screwed into the axial opening 82.

In turn, an orifice outlet 88 defining an orifice 90 is screwed into the orifice body 84, as shown.

To allow for the fact that the through bores 78 and inlet ports 80 may not be aligned, a groove 81 is provided around the outside of the valve insert 76, to ensure that those ports and bores are always in communication with one another.

A plurality of ducts, here six ducts, 92 extend through the insert 76.

Again, the valve body 70 is precision machined from J55 steel, and the insert 76 is formed from 316 stainless steel. The orifice body 84 and orifice outlet 88 are similarly formed from 316 stainless steel and are sized to enhance gasification of the oil flow. The valve body 70 would be provided in sizes corresponding to standard API sizes 2⅜" EUE and 2⅞" EUE.

For both the gas injector valve 33 and check valve 37, different materials can be selected for various components, particularly to resist abrasive and corrosive conditions. Further, they can be provided with a common handling tool for inserting the inserts into the respective valve bodies.

As shown in FIG. 4, the ducts 92 are parallel with the axis of the valve body 70. Further, as shown at 93, the inlets of the ducts 93 could be countersunk or otherwise tapered, to provide a desired flow pattern. The degree of countersinking can be varied depending upon conditions, oil type, etc. Also, although the ducts 92 are shown parallel to the axis of the valve body 70, they could be inclined. Thus, all the ducts 92 could be similarly inclined so as to create a swirl effect, to promote mixing of the injected gas with the oil.

Figure 5:
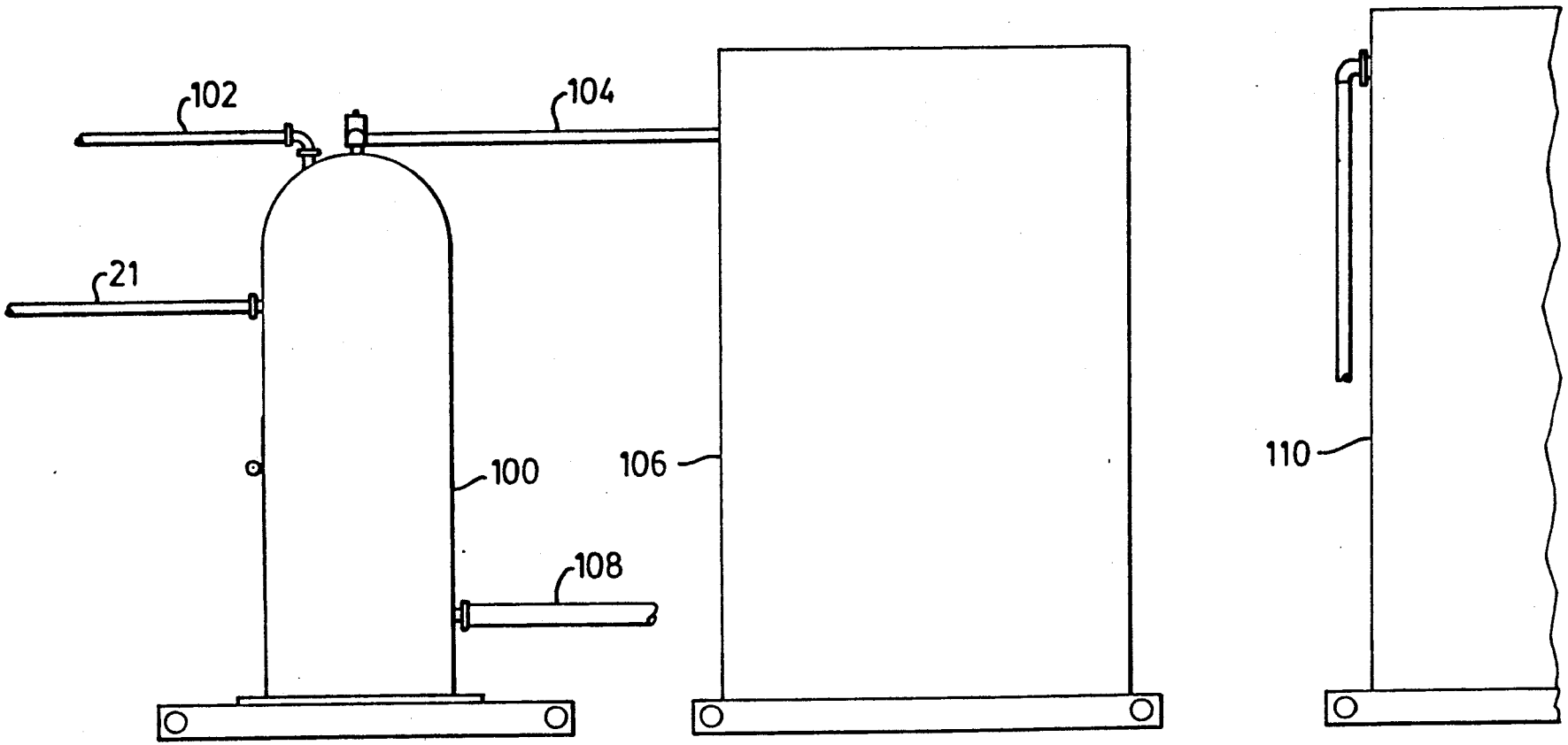
FIG. 5 is a schematic side view of separation and storage tanks for the gas lift system of the present invention.

Turning FIG. 5, the line 21 is connected to a vertical separator 100, which has a suction line 102 connected to a gas compressor. Gases are separated from the oil in the separator 100 and the separated gases are drawn up through line 102, at a pressure in the range 0–30 p.s.i. and supplied through the line 15 back down into the well.

Separator 100 also has a line 104 connected to 100 barrel pop tank 106. A further line 108 is connected either to larger storage tanks, indicated at 110, or to an oil pipe line.

Figure 6:
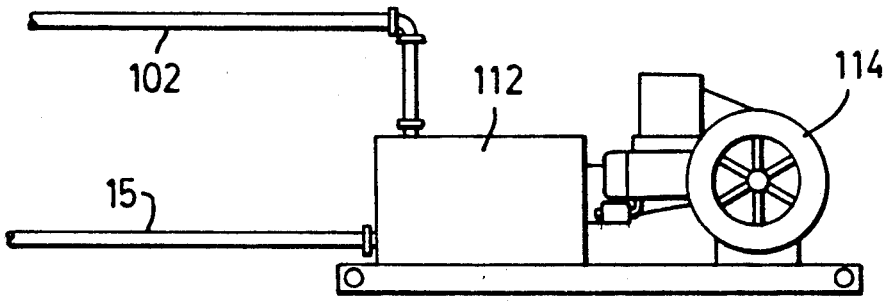
FIG. 6 is a schematic view of a compressor for the gas lift system of the present invention.

As shown in FIG. 6, a compressor 112 is powered by a prime motor 114, and pressurises the gas to a pressure in the range 0–500 p.s.i.

Accordingly, in use, production gases taken from the separator 100, are pressurized to the desired pressure, and injected through line 15 into the annulus 19. The pressure is selected to enable the production gas to flow into the injection valve 33 at the desired rate. This pressure causes the gas to flow through the radial through bores 78 and the inlet ports 80 to the orifice body 84, the gas flowing through the groove 81 if necessary. The check valve 86 ensures that the gas can only flow in one direction, and back flow of oil is prevented. Gas is then injected through the orifice 90 into the flow of oil passing up through the ducts 92. This causes the oil to become gasified, causing it to rise up through the production tubing 5 to the surface.

The oil flow comes from the formation through perforations or fractures, indicated at 47. The oil flows into the well bore and is forced up by bottomhole pressure into the bottom of the production tubing 5 below the packer 41. The oil flows through the perforations of the perforated tube portion 43 into the production tubing 5 and through the standing check valve 37. The oil then flows through into the injection valve 33, where it is gasified and rises to the surface. The gasified oil then passes through line 21 to the separator 100, where the gas is separated and oil transferred to storage tanks 106, 110.

For wells of low GOR (Gas Oil Ratio), it may be necessary to provide a gas purge or swabbing-in for startup. Conversely, for wells of high GOR, the gas injection system may need to be set at a lower rate, to maximize gas production from the producing zone. For wells that produce high paraffin buildup, asphaltines scale and other problems, chemical injection treatment can be provided through the annulus 19 in known manner.

As compared to the conventional pump assembly at a wellhead, the gas injection system would eliminate: the buttom hole pump, the sucker rod string, the pump jack, and pumping oilhead equipment. This in turn eliminates such problems as parted rods, rods cutting production tubing at dog legs and rod hangup due to paraffin and deviation problems. It further eliminates maintenance difficulties due to lack of pump parts and maintenance expenses associated with costs of setting up the pump jack jack equipment and wellhead equipment repair. It is anticipated that the present system could considerably reduce production equipment costs, depending upon the characteristics of an individual installation. It is anticipated that the gas lift injector will be particularly suited where there is a high GOR, near flowing conditions and suitable API gravities.

In contrast to a conventional wellhead equipment, the equipment required for the present invention comprises, the injection valve 33; an appropriate sized gas compressor; the oil and gas separator 100; miscellaneous gauges, valves, fittings and line pipes; flowing wellhead; an electric or gas prime prime mover to power gas compressor; tubing drain (optional); and a strainer nipple, the perforated tube portion 43.

Whilst the injection system, and particularly the gas injection valve 33, are intended for oil wells, they can also be applied to gas wells that tend to "make water". That is for use on gas wells where water tends to migrate from a formation into the well wall and cause a hydrostatic build up with water, which causes the gas flow to diminish and eventually stop flowing.

Gas injection valve 33 can be located at the bottom of the tubing string just above a packer. When water builds up in the tubing, a burst of compressed gas sent from the surface can be injected down the annulus, through the injector and the tubing. This causes the water to be bubbled up to the surface and out to a collection pit or tanks. Foaming agents can also be used, to enhance water lift. On the surface, a storage tank holding compressed gas can be provided with flow indicators, to enable automated opening and closing of the gas supply.

Conventionally, when there is a water build up, nitrogen or air are used in an attempt to flow out the water. Usually, a foaming agent is used. Usually, this requires costly tubing rigs, and where nitrogen is used, there is the cost of nitrogen supplied. The above-described technique eliminates these complexities and costs.

We claim:

1. An injection valve for use in a well, to provide gas lift to a fluid, the valve comprising:

a valve body having an inlet in one end and an outlet at the other end, adapted to be fitted into production tubing;

a plurality of ducts extending through the valve body between the inlet and the outlet thereof for a flow of fluid;

a gas injection port opening into the outlet of the valve body, and at least one gas inlet opening in the side of the valve body, which inlet opening is in communication with the gas injection port, for the supply of gas thereto from outside the valve body.

2. An injection valve as claimed in claim 1, wherein the ducts are uniformly spaced around the axis of the valve.

3. A valve as claimed in claim 2, wherein the ducts are parallel with the axis of the valve and symmetrically arranged around the central axis thereof.

4. A valve as claimed in claim 2, wherein the ducts are inclined at an angle to the axis of the valve, to provide a swirl component to fluid flow through the valve.

5. A valve as claimed in claim 3 or 4, wherein inlet ends of the ducts, adjacent the inlet of the valve body, are tapered.

6. A valve as claimed in claim 2, wherein the valve body includes a separate valve insert, in which the plurality of ducts and the gas injection port are provided, wherein the valve body includes a central portion having an internal thread and wherein the insert has an external thread engaged with that internal thread to secure the insert.

7. A valve as claimed in claim 6, which includes a plurality of gas inlet openings, each of which comprises a radial through bore in the central portion in the valve body and a generally radial inlet port in the insert, the insert additionally being provided with an external groove around the inlet ports therein, to accommodate any misalignment between the inlet ports and the radial through bores.

8. A valve as claimed in claim 6, wherein the insert includes an orifice body providing the gas injection port, which is in communication with the gas inlet opening, which orifice body is provided with a check valve preventing back flow into the gas injection port.

9. A valve as claimed in claim 8, wherein the insert further includes an orifice outlet mounted to the orifice body, wherein the gas injection port comprises an orifice defined by the orifice outlet.

10. A valve as claimed in claim 9, wherein each gas inlet opening comprises a radial through bore in the valve body and an inlet port in the insert extending generally radially therein and in communication with the gas injection port, with the insert being provided with a circumferential groove around the inlet ports, to accommodate any misalignment between the insert and the valve body.

11. A valve as claimed in claim 6, in combination with a gas injection system including a wellhead; a casing extending down from the wellhead; production tubing extending down from the wellhead within the casing to define an annulus between the production tubing and the casing, with the valve being located in the production tubing;

a packer provided between the production tubing and the casing below the valve;

a gas compressor connected to the wellhead for injecting compressed gas into the annulus; and a separation tank having an inlet line connected to the wellhead for supply of a flowing gas mixture, and an outlet line for separated gas connected to the gas compressor.

12. A combination as claimed in claim 11, further including a check valve located in the production tubing below the gas injection valve.

13. A combination as claimed in claim 12, wherein the check valve comprises a check valve body having an inlet and an outlet adapted to engage and engaging the production tubing, a central portion defining an internal thread, and a separate valve insert, which defines the valve seat and includes a ball check valve.

14. A combination as claimed in claim 13, wherein the valve inserts for the check valve and the gas injection valve are provided with corresponding engagement formations, whereby a common tool can be used for inserting each insert into its respective valve body.

* * * * *